United States Patent [19]

Kobayashi et al.

[11] Patent Number: 4,563,992

[45] Date of Patent: Jan. 14, 1986

[54] DIESEL FUEL INJECTION PUMP WITH ELECTRONICALLY CONTROLLED FUEL SPILLING AND CUTOFF AND RECIRCULATION VENTING OF SPLIT FUEL

[75] Inventors: Fumiaki Kobayashi; Yoshiyasu Ito, both of Toyota, Japan

[73] Assignee: Toyota Jidosha Kabushiki Kaisha, Toyota, Japan

[21] Appl. No.: 650,165

[22] Filed: Sep. 13, 1984

[30] Foreign Application Priority Data

Nov. 18, 1983 [JP] Japan ..... 58-178946[U]

[51] Int. Cl.[4] ..... F02M 41/00

[52] U.S. Cl. ..... 123/458; 123/459

[58] Field of Search ..... 123/458, 459, 449, 506, 123/446

[56] References Cited

U.S. PATENT DOCUMENTS

| | | | |
|---|---|---|---|
| 1,664,608 | 4/1928 | French | 123/458 |
| 4,385,614 | 5/1983 | Eheim et al. | 123/506 |
| 4,395,987 | 8/1983 | Kobayashi et al. | 123/458 |
| 4,412,519 | 11/1983 | Hoch et al. | 123/458 |
| 4,458,648 | 7/1984 | Braun et al. | 123/459 |
| 4,480,619 | 11/1984 | Igashira et al. | 123/458 |

FOREIGN PATENT DOCUMENTS

| | | | |
|---|---|---|---|
| 65858 | 4/1982 | Japan | 123/449 |
| 128461 | 8/1983 | Japan | 123/506 |
| 2061403 | 5/1981 | United Kingdom | 123/506 |

*Primary Examiner*—Magdalen Y. C. Moy

*Attorney, Agent, or Firm*—Kenyon & Kenyon

[57] ABSTRACT

A fuel injection pump for a diesel engine includes a housing having a bore within which a plunger reciprocates according to the operation of the engine, the bore defining a pumping chamber at an end of the plunger. The pumping chamber is being communicated to a fuel intake passage only when the plunger is moving in a direction to enlarge the size of the pumping chamber and being communicated to fuel injection nozzles only when the plunger is moving in a direction to reduce the size of the pumping chamber. A first electromagnetic valve for fuel shutoff is provided at a middle portion of the fuel intake passage. A second electromagnetic valve, advantageously used also for fuel amount control by timely venting the pumping chamber in its compression stroke, communicates the pumping chamber to the intake passage downstream of the first electromagnetic valve for at least a predetermined short time period when the first electromagnetic valve is closed.

4 Claims, 3 Drawing Figures

DIESEL FUEL INJECTION PUMP WITH ELECTRONICALLY CONTROLLED FUEL SPILLING AND CUTOFF AND RECIRCULATION VENTING OF SPLIT FUEL

BACKGROUND OF THE INVENTION

The present invention relates to a fuel injection pump for a diesel engine, and more particularly relates to a diesel fuel injection pump in which fuel spilling is controlled at the stoppage of the engine for the readiness of the restarting, and in which venting of the split fuel is performed by recirculating it.

There is known a type of fuel injection pump or a diesel internal combustion engine which includes a plunger which reciprocates to and fro in a bore defined in a housing, a high pressure chamber being defined between one end of the plunger and the end of the bore. During the suction stroke of the plunger as this high pressure chamber expands in size, diesel fuel is sucked into this high pressure chamber from a quantity of diesel fuel contained in a relatively low pressure chamber, through a fuel supply passage; and during the compression stroke of the plunger as the high pressure chamber subsequently contracts in size, this diesel fuel in the high pressure chamber is squeezed and is brought to a high pressure and is ejected through an injection passage therefor to a fuel injector of the diesel internal combustion engine. Sometimes, in the case that the diesel fuel injection pump is a so called distribution type pump, the plunger is rotated as it reciprocates, and by a per se well known construction the spurt of highly compressed diesel fuel is directed to the appropriate one of the plurality of cylinders of the internal combustion engine.

Now, in order to ensure that the diesel engine is definitely and positively stopped from operation when it is desired to do so, it is known to provide an electromagnetic valve for fuel cutoff, which, when the master operation switch of the vehicle in which the engine is mounted (the so called ignition switch) is switched off, definitely interrupts the flow of fuel from the aforementioned relatively low pressure chamber, through a fuel supply passage; when this happens, the diesel engine comes to a halt quite quickly due to shortage of fuel.

However, a problem has occurred with this construction, as follows. Such an electromagnetic valve for fuel cutoff typically comprises a valve seat with a hole therethrough interposed at an intermediate point on the aforementioned fuel supply passage, and a valve element, which is displaced from said valve seat when fuel flow through said fuel supply passage is desired, i.e. when the engine is running, and is pressed against said valve seat so as to close said hole therethrough when fuel flow through said fuel supply passage is not desired, i.e. when the engine is to be stopped. Typically, also, the direction of fuel flow through said hole of said valve seat is in the direction from the side of said valve seat on which said valve element is located, through said hole, towards the other side thereof. Now, if the diesel engine is to be stopped from operation, then as mentioned above the valve element of said electromagnetic valve for fuel cutoff approaches the valve seat and closes its hole, and thus the part of the fuel supply passage downstream of the electromagnetic valve for fuel cutoff is isolated from the upstream part thereof, and fuel flow is prevented. Thus the diesel engine, being deprived of fuel, slows down and stops rotating. However, the diesel engine does continue to rotate for a few seconds or so, and the pumping action of the plunger, which is trying to suck fuel out of said part of the fuel supply passage downstream of the electromagnetic valve for fuel cutoff and to eject it via said electromagnetic fuel amount control valve and via its vent passage to the outside, by succeeding in thus sucking an extremely small amount of fuel (since the fuel is not completely incompressible, and the metallic parts of the pump deform very slightly), causes a substantial negative pressure to be built up in said downstream part of said fuel supply passage. Now, if the diesel engine is left for a long time before any attempt is made to restart it, then through natural leakage this negative pressure becomes gradually cancelled, and no problem is thereby caused. However, if an attempt is made to restart the diesel engine quite quickly, then this negative pressure in the part of the fuel supply passage downstream of the electromagnetic valve for fuel cutoff can forcibly suck the valve element of said valve against the valve seat and can maintain said electromagnetic valve for fuel cutoff closed, even though the control system for the fuel injection pump is attempting to open it electrically. If this happens, the diesel engine is prevented from restarting.

Particularly, this problem is most likely to occur if, while the vehicle is being driven along the road, the master control switch is erroneously switched by the operator of the vehicle to the off position. When this happens, the electromagnetic valve for fuel cutoff is as described above closed by the control system, and because the engine is forcibly kept rotating at a considerable rotational speed by the running of the vehicle along the road and thus the engine rotational speed does not drop, the previously explained negative pressure generated in the portion of the fuel supply passage downstream of the fuel cutoff valve is particularly severe, and does not diminish, thus presenting a very great likelihood of its holding the fuel cutoff valve closed, even when the operator of the vehicle, recognizing his or her mistake, turns the master control switch back to the on position in an effort to rectify the error and to continue operating the vehicle. In such a case, the vehicle is constrained to come to a complete halt, due to this effect of the negative pressure holding the fuel cutoff valve closed.

An expedient that might be thought of for preventing this problem is to increase the size and the power of the components of the electromagnetic valve for fuel cutoff, thus overcoming the suction force described above by main force; but this is not completely effective, and moreover means increasing the size and the weight and the cost of the electromagnetic valve for fuel cutoff and therefore of the fuel injection pump as a whole. Accordingly this solution is not a good one.

SUMMARY OF THE INVENTION

Accordingly, it is a general object of the present invention to provide a diesel fuel injection pump which can be reliably operated to shut off the diesel engine to which it is fitted, and also can be reliably operated to restart the engine.

Now, there is nowadays known a type of fuel injection pump for a diesel internal combustion engine in which control of the amount of fuel delivered as an injected pulse by the pump in each stroke of a cylinder of the engine is made, not mechanically as by the use of a spill ring or the like as has been per se known from the past, but electronically by the use of an electromagnetic valve for fuel amount control. In this type of diesel fuel injection pump, its spill performance is readily modified by electronic process modification so as to provide a further spilling of the high pressure diesel fuel in addition to the ordinary spilling of the high pressure diesel fuel for the control of the amount of fuel to be injected into the cylinders of the engine.

Therefore, it is a more particular object of the present invention to provide a diesel fuel injection pump which is of the abovementioned electronic spill control type and which can efficiently accomplish the abovementioned general object of the present invention.

It is a further object of the present invention to provide such a diesel fuel injection pump which presents no risk of the diesel engine not being able to be restarted after it has been turned off.

It is a further object of the present invention to provide such a diesel fuel injection pump, with the use of which the diesel engine can be restarted even after a comparatively very short time interval after it has been turned off.

It is a further object of the present invention to provide such a diesel fuel injection pump, with the use of which the diesel engine can be restarted after it has been turned off, even if the engine has been forcibly rotated continuously during that period.

It is a further object of the present invention to provide such a diesel fuel injection pump, incorporating an electromagnetic valve for fuel shutoff as described above, in which there is no risk of any very substantial negative pressure being generated downstream of said electromagnetic valve for fuel shutoff, when said valve is operated to stop the diesel engine operating, even though the engine may continue to rotate for a short time.

It is a yet further object of the present invention to provide such a diesel fuel injection pump, which is compact and light in weight.

It is a yet further object of the present invention to provide such a diesel fuel injection pump, which is economical to manufacture.

According to the most general aspect of the present invention, these and other objects are accomplished by, for a diesel engine: a fuel injection pump comprising: (a) a housing and a plunger which reciprocates in a bore formed in said housing according to the operation of said diesel engine, a high pressure chamber being defined at an end of said plunger between it and said bore; (b) a first electromagnetic valve for fuel shutoff, to an upstream side of which is supplied diesel fuel at relatively low pressure; (c) a fuel supply passage leading from said first electromagnetic valve towards said high pressure chamber; (d) a means for communicating a downstream end of said fuel supply passage to said high pressure chamber, substantially only when said plunger is moving in a direction to enlarge the size of said high pressure chamber; (e) a means for communicating said high pressure chamber to inject fuel into said diesel engine, substantially only when said plunger is moving in a direction to reduce the size of said high pressure chamber; (f) a means for selectively communicating said high pressure chamber to a vent passage; and (g) a second electromagnetic valve for selectively communicating said high pressure chamber to said downstream end of said vent passage at least for a predetermined short time period only when said first electromagnetic valve is shut off.

According to such a structure, since the downstream end of said vent passage is communicated to said fuel supply passage, when said first electromagnetic valve for fuel shutoff is closed and still said diesel engine is turning and is reciprocating said plunger, the residual fuel still being pumped by said plunger from said fuel supply passage and being vented from said high pressure chamber via said second electromagnetic valve to said vent passage is returned to said fuel supply passage, thus preventing the generation of a negative pressure in said fuel supply passage. Thereby, the holding of said first electromagnetic valve in the closed state by such negative pressure is effectively prohibited. And this is done without any need for making the parts of the first electromagnetic valve strong or powerful, or large or heavy; and accordingly cost of the fuel injection pump also is minimized.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENT

Figure 1:
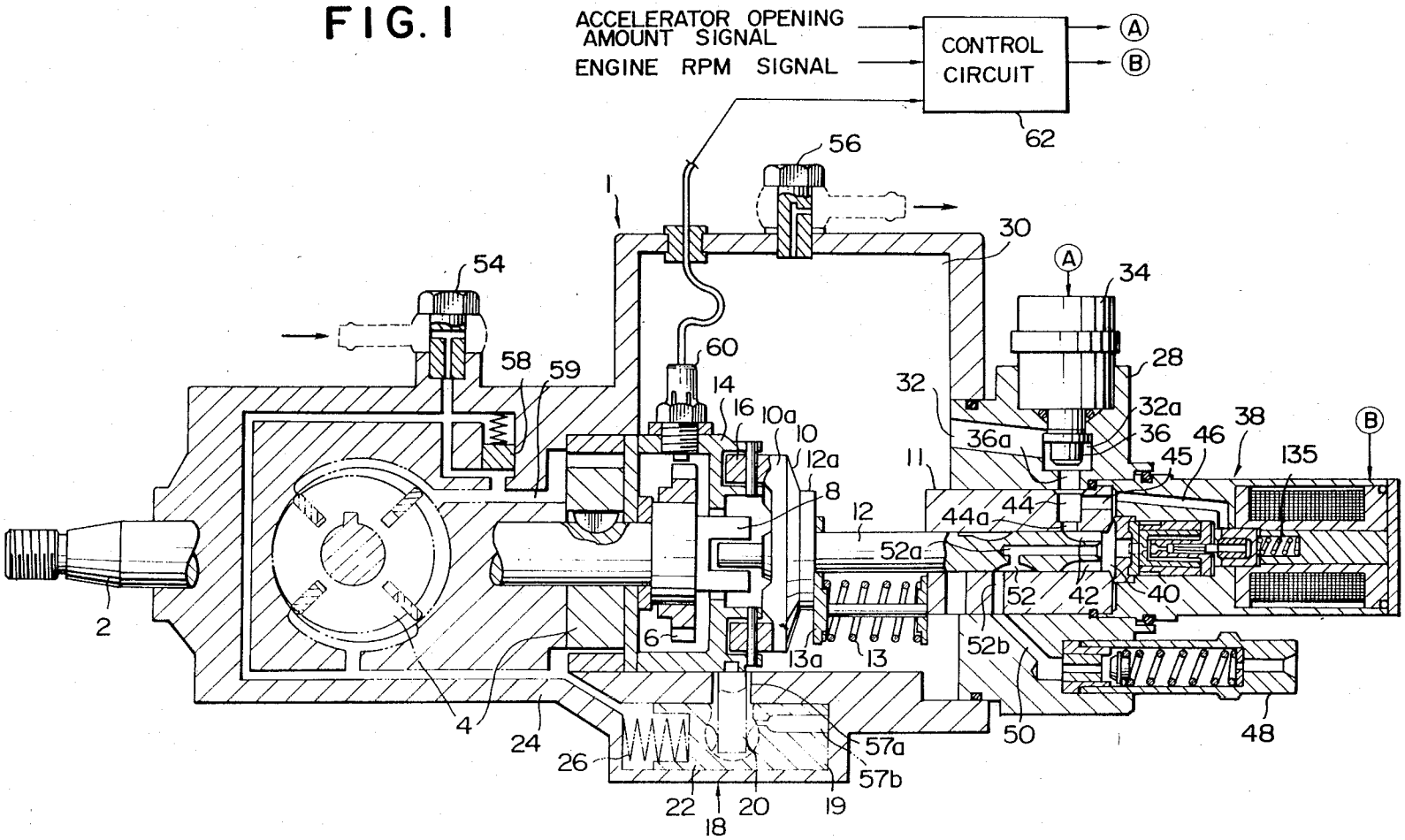
FIG. 1 is a sectional longitudinal view, in part 90° expansion, of the preferred embodiment of the diesel fuel injection pump of the present invention.

The present invention will now be described with reference to the preferred embodiment thereof, and with reference to the appended drawings. Referring to FIG. 1, this diesel fuel injection pump 1 is an electromagnetic spilling type distribution type fuel injection pump, and comprises a drive shaft 2 adapted to be driven by a crankshaft, not shown, of a diesel engine, also not shown, in a fixed phase relationship thereto. This drive shaft 2 drives a vane type feed pump 4 (also shown in a section plane in FIG. 1 which is at 90° to the general plane of the figure), which feeds diesel fuel supplied via a fuel supply connection 54 and, under the control of a venting pressure control valve 58, under a moderate pressure (which is representative of the rotational speed of said vane pump 4 and thus of the rotational speed of the drive shaft 2 and of the diesel engine) through a passage 59 to a large fuel chamber 30 defined within the housing 24 of the fuel injection pump, fuel in said large fuel chamber 30 being vented, when appropriate, via a fuel return connection 56 incorporating a proper orifice passage. The drive shaft 2 has mounted at an intermediate position on it a signal rotor 6 having a plurality of teeth, and is at its right end in the figure formed with a coupling shape 8. An electromagnetic pickup 60 is mounted by a roller ring 14 described later in the housing 24 opposing the teeth of the signal rotor 6 for producing electrical signals regarding the angular position of the drive shaft 2 when the teeth of said rotor 6 pass it. A generally cylindrical plunger 12 is mounted with its central axial line coincident with the central axis of the drive shaft 2, and its left end in the figure is formed in a coupling shape which fits together with the coupling shape 8 of the drive shaft 2 so that the plunger 12 is rotationally coupled to the drive shaft 2 while being free to move axially with respect thereto. The cylindrical right end in the figure of the plunger 12 is closely and cooperatingly fitted into a cylindrical bore formed in a boss portion 11 fitted in the pump housing 24 and can slide and rotate freely in said bore; and the plunger 12 is biased to the left in the figure by a compression coil spring 13 and a collar 13*a* fitted on a flange shaped portion 12*a* of the drive shaft 2 and associated spring receiving elements.

A cam plate 10 is fixedly secured around the left hand end in the figure of the plunger 12 and rotates integrally therewith, and the left hand side of this cam plate 10 is formed in an axial circular cam shape bearing a plurality of convex and concave cam portions. The roller ring 14, which supports the electromagnetic pickup 60, is rotatably mounted to the housing 24 of the fuel injection pump, around the coupling shape 8 and mutually concentric therewith, and is provided with a plurality of cam rollers 16 rotatably mounted along the outer circumferential part of its right hand side in the figure, bearing against the cam plate 10, with the central rotational axis of each of said cam rollers 16 extending radially perpendicular to the central axis of the drive shaft 2. The roller ring 14 is rotatably mounted to the pump housing 24, and its angular position is variably controlled with respect thereto by a timer 18, schematically shown in a section plane at 90° to the general plane of the figure, and this timer 18 comprises a timer piston 22 slidably mounted in a bore formed in the pump housing 24 and a pin 20 radially mounted to the roller ring 14 and engaged at its free end portion with the timer piston 22 so as to be rotationally turned and to rotationally position said roller ring 14. The timer piston 22 is biased in its rightwards axial direction in the figure as viewed in said 90° turned section plane by a compression coil spring 26 mounted between the left hand end of the time piston in the figure and the corresponding end of its bore, and is biased in the leftwards axial direction by the output pressure of the vane pump 4, which is supplied via passages 57*a* and 57*b* to a chamber 19 defined at the right hand end in the figure of said bore, in such a manner that the axial movement of the timer piston 22 leftward in the figure is representative of the rotational speed of the crankshaft of the engine, and drives the roller ring 14 to rotate it in the direction opposite to the rotational direction of the drive shaft 2 so as to advance the fuel injection timing.

A control circuit 62 for the fuel injection pump 1 comprises a microcomputer, not particularly shown in detail, which has a central processing unit (CPU), a read only memory (ROM), a random access memory (RAM), and so on. The read only memory (ROM) has permanently stored in it a control program concerning fuel injection amount and so on, which includes a subroutine which will be described later. The control circuit 62, as a whole, receives (among other signal) a signals representative of accelerator opening amount and a signal representative of engine rotational speed, which are obtained from sensors not shown in the figure, and also receives the angular position signal from the pickup 60 described earlier representative of crank angle, and performs control of fuel injection amount and other matters according to these signals.

Figure 2:
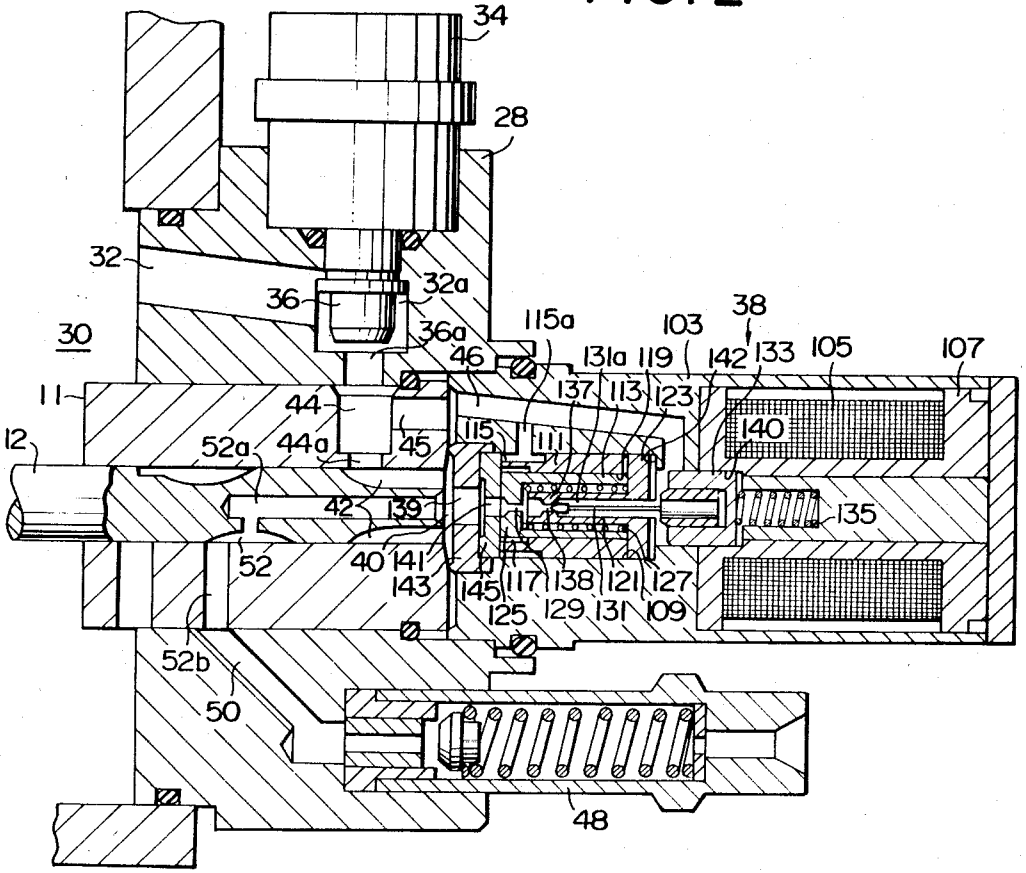
FIG. 2 is an enlarged sectional view of a right hand side part from the point of view of FIG. 1 of said preferred embodiment, taken in the same sectional plane as FIG. 1 and particularly showing the construction of a high pressure chamber and an electromagnetic fuel spilling valve.

On the right hand side in FIG. 1 of the fuel injection pump 1 there is mounted in the housing 24 a block 28, in which the aforementioned boss 11 is fitted; this part of the construction is best seen in FIG. 2, which is an enlarged view thereof. A fuel passage 32 leads from the large fuel chamber 30 to an intermediate fuel chamber 32*a* defined within the block 28, and a passage 44 leads from said intermediate fuel chamber 32*a* to a fuel supply port 44*a* which opens in the side surface of the cylindrical bore in the boss 11 in which the plunger 12 reciprocates. An electromagnetic valve 34 for fuel shutting off is provided, and a valve element 36 of this valve 34 is so constructed and arranged that: when the solenoid coil (not particularly shown) of the electromagnetic valve 34 is supplied with actuating electrical energy, the valve element 36 is moved upwards in the figures away from the upper end 36*a* of the passage 44, thus opening said upper end 36*a* and allowing communication between the passage 32 and the passage 44; but, on the other hand, when said solenoid coil of this electromagnetic valve 34 for fuel shutting off is not supplied with actuating electrical energy, the valve element 36 is moved downwards by the action of a spring (likewise not shown) towards said upper end 36*a* of the passage 44 and blocks it, thus interrupting communication between the passage 32 and the passage 44.

The outer cylindrical surface of the right hand end of the plunger 12 is formed with a plurality of axially extending grooves 42, which are equally spaced around said plunger 12 and reach its end and whose number is the same as the number of cylinders of the diesel engine and which are arranged sometimes one or other to coincide with the fuel supply port 44*a*, according to rotation and reciprocation of the plunger 12; and a central axial hole 52*a* is formed along the axis of said plunger 12, one end of said hole 52*a* opening to the right hand end surface of the plunger 12 and the other end of said hole 52*a* opening to a side notch port 52 provided on the outer cylindrical surface of an intermediate portion of the plunger 12. A plurality of delivery valves 48 the same in number as the number of cylinders of the diesel engine are mounted in the block 28 (only one of the valves 48 with its associated arrangements is shown in the drawing for the purposes of simplicity). The inlet of each of these delivery valves 48 is selectively supplied with diesel fuel via a passage 50 which leads to a fuel receiving port 52*b* which opens in the side surface of the cylindrical bore in the boss 11 in which the plunger 12 reciprocates; the ports 52*b* are equally spaced around the plunger 12 and also are the same in number as the number of cylinders of the diesel engine. Although it is not so shown in the figures, in fact each of the delivery valves 48 is connected via a high pressure fuel pipe to a fuel injector fitted in one of the cylinders of the diesel engine, for supplying diesel fuel under high pressure thereto at an appropriate amount and timing. The side notch port 52 is arranged to sometimes coincide with one or other of the fuel receiving ports 52*b*, also according to rotation and reciprocation of the plunger 12.

A high pressure chamber 40 is defined between the right hand end of the plunger 12 and an electromagnetic valve for fuel spilling 38 fitted to the block 28 and closing the end of the cylindrical bore in the boss 11 in which side plunger 12 reciprocates, in cooperation with the cylindrical side surface of said bore, with the ends of the notches 42 and the end of the central hole 52*a* in the plunger 12 communicating to this high pressure chamber 40; and this electromagnetic valve for fuel spilling 38 regulates escape of fluid from the high pressure chamber 40. Particularly according to the gist of the present invention, the fuel vent passage 46 of this electromagnetic valve for fuel spilling 38 is communicated, via an intermediate passage 45 formed in the boss 11, to an intermediate point, downstream of the electromagnetic valve 34 for fuel shutting off, on the fuel supply passage 44 leading from the intermediate fuel chamber 32*a* to the fuel support port 44*a* in the side surface of the bore of the plunger 12.

The electromagnetic valve for fuel spilling 38 comprises a housing 103 in which the return passage 46 mentioned above is formed, and an iron core 107 is fitted in this housing 103 and has an electromagnetic coil 105 wound around it. A cylindrical bore 109 of relatively large diameter formed in the valve housing 103 has a first cylindrical piston 111 fitted therein so as to be reciprocable along the axis thereof. The first piston 111 is hollow and has a cylindrical bore formed along its axis, and a second cylindrical piston 113 is fitted in this bore so as to be reciprocable along the axis of the first piston 111. This second piston 113 is also hollow and has a cylindrical bore 119 formed along its axis, and a third cylindrical piston 121 is loosely fitted in this bore 119 with a certain gap being left therebetween so as to be reciprocable along the common axis of the first and second pistons 111 and 113. The outer diameter of the end portion of the first piston 111 towards the high pressure chamber 40 is reduced so as to define a relatively thin annular space 115 between said end portion of said piston 111 and the bore 109 formed in the housing 103, and this space 115 is communicated via a passage 115*a* with an intermediate point on the return passage 46. Also, the inner diameter of this end portion of the first piston 111 towards the high pressure chamber 40 is increased so as to define a relatively thin annular space 117 between said end portion of said piston 111 and the outer circumferential surface of the second piston 113.

A compression coil spring 127 is fitted around the third piston 121, between its outer surface and the inner surface of the bore 119 in the second piston 113 in which said third piston 121 is loosely fitted, and the ends of this compression coil spring 127 bear on a large diameter flange 123 formed on the right hand end of the third piston 121 and on the bottom 125 of the bore 119, so as to bias the third piston 121 rightwards relative to the second piston 113 as seen in the figure. A hole 129 is formed through this bottom 125 of the bore of the second piston 113 so as to communicate the internal space within the bore 119 with the high pressure chamber 40 which axially opposes these three pistons 111, 113, and 121 fitted inside one another through below mentioned holes 139 and 141. A movable member 133 is slidably fitted in a bore 140 in the iron core 107, coaxial with and axially opposing the three pistons 111, 113, and 121, and is biased to the left in the figure by a compression coil spring 135. A valve needle 131 is crimped to the movable member 133 and extends axially leftwards therefrom into a bore 131*a* formed along the central axis of the third innermost piston 121, and the end of this valve needle 131 cooperates with a valve seat 137 formed in this bore 131*a*, so as selectively either to open or to close a hole 138 in said valve seat 137 according as the valve needle 131 is pushed against this valve seat 137 or not and thus to selectively open or close the bore 131*a*. The right hand end of the bore 131*a* is communicated to the end of the return passage 46. The axial positions of the three pistons 111, 113, and 121 are determined, within certain small limits, by the flange 123 of the third piston 121 to abut an annular right end 142 of the cylindrical bore 109 on the right, and by two washers 143 and 145 on the left, said two washers 143 and 145 having respective holes 139 and 141 formed in them so that the left end of the bore 131*a* of the third piston 121 is communicated with the high pressure chamber 40.

Thus, when no electrical energy is supplied to the coil 105, then the iron core 107 is not magnetized, and thus the compression coil spring 135 biases the movable member 133 and the valve needle 131 crimped thereto leftwards in the figure, so that the end of the valve needle 131 closes the hole 138 in the valve seat 137, and this seals off the high pressure chamber 40 from the return passage 46. On the other hand, when actuating electrical energy is supplied to the coil 105, then the iron core 107 is magnetized, and then, against the biasing action of the compression coil spring 135 which is overcome, the movable member 133 and the valve needle 131 crimped thereto are pulled thereby rightwards in the figure, so that the end of the valve needle 131 opens the hole 138 in the valve seat 137, and this opens a relatively small and restricted opening from the high pressure chamber 40 to the return passage 46, allowing a relatively small flow of fluid out from the pressure chamber 40. At this time, the third piston 121 is displaced rightwards relative to the first piston 111, and the second piston 113 is also displaced rightwards relative to the first piston 111 due to the pressure difference between the two sides of its bottom 125. Due to this lifting of the second piston 113 relative to the first piston 111, high pressure fuel from the high pressure chamber 40 flows into relatively thin cylindrical space 117, thereby displacing the first piston 111 to the right relative to the housing 103 of the valve, and thus allowing a relatively large flow of fluid to pass out from the pressure chamber 40 to the return passage 46 through an annular space formed between the washer 143 and the left end of the first piston 111, the cylindrical space 115, and the passage 115*a*.

Now, the action of this fuel injection pump 1 during operation of the diesel engine will be described. When the engine is running and the crankshaft (not shown) of said engine is rotating, the drive shaft 2 is rotated in synchronism therewith and at a fixed phase in relation thereto, and drives the vane pump 4. Fuel pressurized to the output pressure of said vane pump 4, which is representataive of the rotational speed of said drive shaft 2 and of said crankshaft of the engine, is fed into the chamber 30 and into the fuel passages 32 and 44 and also into the actuating chamber 19 of the timer assembly 18, so as to cause the timer piston 22 to be driven leftwards in the figure (90° section plane) by an amount corresponding to said rotational speed of said engine, thus rotating the roller ring 14 and the rollers 16 mounted thereon by a similarly corresponding amount from their starting rotational positions relative to the housing 24 in the direction opposite to the rotational direction of the drive shaft 2. Meanwhile, as the drive shaft 2 and the plunger 12 rotate in synchronism with one another, and as the cam plate 10 is also rotated, the cam projections 10*a* are caused to ride up and down the rollers 16, so as to reciprocatingly drive the plunger 12 against the biasing force of the compression coil spring 13 leftwards and rightwards in the figure at appropriate timing governed by the aforesaid rotational position of the roller ring 14, as said plunger 12 also rotates, i.e. according to the rotational speed of the diesel engine.

While the master running or ignition switch of the vehicle is turned on and the diesel engine is running, actuating electrical energy is being supplied to the electromagnetic valve 34 for fuel shutting off, and so its valve element 36 is displaced from the valve seat 36*a* and the fuel passage 32 is in communication with the fuel passage 44. Therefore, on each of the suction or leftward strokes of the plunger 12 when one of the notches 42 is corresponding to the fuel supply port 44*a* which opens in the side surface of the cylindrical bore in the boss 11, diesel fuel at low pressure is sucked into the high pressure chamber 40 from the chamber 30 through said fuel passages 32 and 44.

When thereafter the plunger 12 moves rightwards during its subsequent compression stroke, by the rotation of said plunger 12 said one of the notches 42 is no longer corresponding to the fuel supply port 44*a*, and accordingly back flow of diesel fuel to the passage 44 is prevented; and also the side notch port 52 is now coinciding with an appropriate one of the fuel receiving ports 52*b*, also according to rotation of the plunger 12, so as to direct diesel fuel which is now being compressed in the high pressure chamber 40 by the rightward movement of the plunger to the appropriate one of the fuel delivery valves 48, via the hole 52*a* and said side notch port 52, so as to be injected into the appropriate cylinder of the engine (not shown) via the relevant fuel injection valve, according to the per se well known distribution function of this fuel injection pump. However, this compression process of the diesel fuel within the high pressure chamber 40, and the injection thereof through the fuel delivery valve 48, will take place only if the coil 105 of the electromagnetic valve for fuel spilling 38 is not being provided with actuating electrical energy and thus said valve 38 is closed and is preventing communication between the high pressure chamber 40 and the vent passage 46. On the other hand, when actuating electrical energy is provided to said coil 105 of the valve 38, then the valve needle 131 is displaced from the valve seat 137 as explained above, and the high pressure chamber 40 is communicated with the vent passage 46, thus venting the compressed diesel fuel in the chamber 40 back to the intermediate portion of the fuel passage 44 to which said vent passage 46 communicates, and thereby cutting off fuel injection.

During normal running of the diesel engine, the control circuit 62 supplies actuating electrical energy to the electromagnetic valve for fuel spilling 38 at an appropriate timing point during each fuel injection stroke of the plunger 12, so as to open said valve 38 and to cut off further fuel injection during this plunger stroke, according to the various signals regarding engine operational parameters which said control circuit 62 receives from its various sensors such as the sensor 60, and according to accelerator pedal depression amount: this is how the amount of fuel injectingly supplied to the diesel engine, and thereby the load on said diesel engine, is controlled. This action of the control circuit 62 in venting the high pressure chamber 40 at an appropriate timing point is analogous to the operation of a spill ring in a conventional type of diesel fuel injection pump.

Figure 3:
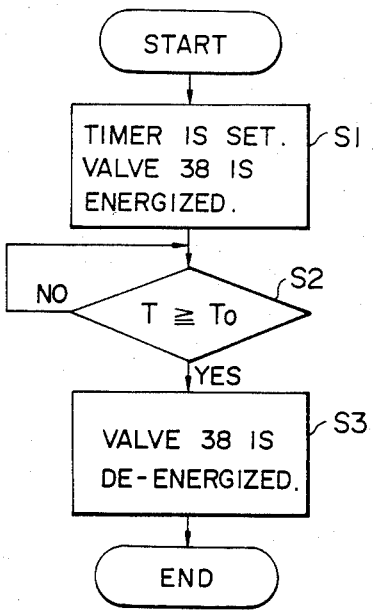
FIG. 3 is a flow chart of a subprogram stored in a microcomputer incorporated in this preferred embodiment, said subprogram being initiated and utilized when the diesel engine is to be stopped.

Now, when the diesel engine is running and it is desired to stop it from running, the master running switch of the vehicle is turned off by the operator, and this immediately causes stopping of supply of electrical energy to the electromagnetic valve 34 for fuel shutting off, so that its valve element 36 is moved against the valve seat 36*a* by the force of its biasing spring (not particularly shown) and communication between the fuel passage 32 and the fuel passage 44 is interrupted. Therefore, supply of new fuel to the diesel engine is substantially terminated, but since the crankshaft is still rotating the plunger 12 is still being reciprocated to and fro in synchronism therewith. Since the electromagnetic valve for fuel spilling 38 in this preferred embodiment is of the type which is normally closed, i.e. is closed when not supplied with actuating electrical energy, at this time when the master running switch is turned off while the diesel engine is running a subroutine is executed in the program stored in the random access memory of the microcomputer in the control circuit 62, a flow chart of which is shown in FIG. 3. This program ensures that actuating electrical energy to the coil 105 of the valve 38 is specially supplied or continuously maintained when it is being supplied for a certain time period, for example about five seconds, after the master switch is turned off, thus ensuring that the valve 38 is open and vents the high pressure chamber 40 to the passage 46 during this time period, thereby disabling the plunger 12 to pump the fuel toward the delivery valves 48 while it is driven by the inertia of the engine until it comes to a definite and complete rotational halt.

In detail, in this program, step S1 of a timer is set and an actuation electrical signal is started to be sent to the coil 105 of the valve 38. In step S2 a test is made as to whether the timer has reached a predetermined time value T0 or not, and if not then the program loops and increments the timer. On the other hand, if the timer has reached its predetermined count value, then in step S3 the supply of the actuation electrical signal to the coil 105 of the valve 38 is stopped.

While the crankshaft of the diesel engine is still rotating although the electromagnetic valve 34 for fuel shutting off is closed with its valve element 36 pressing against the valve seat 36*a*, the pumping action caused by the reciprocation of the plunger 12 still sucks a quantity of fuel out from the passage 44 downstream of the valve seat 36*a* into the high pressure chamber 40, during the leftward stroke of the plunger. However, during the subsequent rightward compression stroke of the plunger 12, this fuel which has been taken into the high pressure chamber 40 is expelled through the open electromagnetic valve for fuel spilling 38 into the return or vent passage 46 to be returned to the passage 44, i.e. not to be supplied towards the delivery valves 48. Therefore, the negative pressure generated in the fuel supply passage 44 in the conventional diesel fuel injection pump as described earlier is substantially neutralized by the returning of the sucked away diesel fuel thereto.

Thus, according to the present invention, when the diesel engine has completely come to a halt, there is definitely not generated in the passage 44 downstream of the valve seat 36*a* any substantial negative pressure sufficiently high that, when later the diesel engine is to be restarted and the master switch thereof is turned on, thus supplying the electromagnetic valve 34 for fuel shutting off with actuating electromagnetic energy in order to again communicate the passage 32 to the passage 44, this negative pressure aided by the spring force of the valve 34 should suck the valve element 36 thereof down against the valve seat 36*a* and should hold it there against the pulling force exerted by the solenoid coil of said valve 34, thus preventing the opening of the valve 34. Since this danger which was present in the prior art type of construction is effectively eliminated by this concept of connecting the vent passage 46 of the electromagnetic valve 38 for fuel spilling back to an intermediate point on the conduit 44 downstream of the electromagnetic valve 34 for fuel shutting off, and positively opening the electromagnetic valve 38 for at least a predetermined short period from the instant of shutting off of the electromagnetic valve 39, the positive restarting capability for the diesel engine is effectively assured. Further, this is done without any need to make the elements of the electromagnetic valve 34 for fuel shutting off large or heavy or costly, because no requirement for overcoming such a suction force in the conduit 44 by brute force is made.

It is possible to use a normally open type of electromagnetic valve as the electromagnetic valve 38 for fuel spilling instead of the normally closed type of this preferred embodiment; and in such a case when the valve 38 is supplied with actuating electrical energy then it is closed and fuel in the high pressure chamber 40 is pressurized and is injected through one of the valves 48 into one or the other of the cylinders of the engine, whereas on the other hand when the valve 38 is not supplied with electrical energy then it is opened, thus spilling the fuel from the high pressure chamber 40 back to the passage 46. In such a construction, no program such as the subroutine shown in FIG. 3 is required to be utilized when the master switch for the diesel engine is closed, since the cessation of supply of electrical energy for the system as a whole from the master switch can be employed for definitely deenergizing the valve 38 and for thus definitely constantly venting the high pressure chamber 40.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. For example, it would be possible to apply the present invention to a spill ring type diesel fuel injection pump, by providing an electromagnetic valve such as the valve 38 only for the purpose of temporarily venting the high pressure chamber 40 to the suction passage 44. Therefore it is desired that the scope of the present invention, and of the protection sought to be granted by Letters Patent, should be defined not by any of the perhaps purely fortuitous details of the shown preferred embodiment, or of the drawings, but solely by the scope of the appended claims, which follow.

What is claimed is:

1. A fuel injection pump for a diesel engine, the pump comprising:

(a) a housing having a bore formed therein;

(b) a plunger slidably fitted in said bore for reciprocation with respect to the housing in response to rotation of the engine, the bore defining a high pressure chamber at one end of the plunger;

(c) a first electromagnetic valve for shutting off fuel to the pump when the engine is not running, the valve having an inlet adapted to be connected to a source of fuel at relatively low pressure and an outlet;

(d) a fuel supply passage having an upstream end connected to the outlet of the first electromagnetic valve and a downstream end leading to said high pressure chamber;

(e) means for communicating the downstream end of the fuel supply passage with said high pressure chamber substantially only when the plunger is moving in a first direction to enlarge the high pressure chamber;

(f) means for communicating the high pressure chamber with a fuel injection line substantially only when the plunger is moving in a second direction to reduce the size of the high pressure chamber;

(g) means for selectively communicating the high pressure chamber with a vent passage for controlling the amount of fuel delivered during each fuel injection, wherein the improvement comprises:

a second electromagnetic valve having an inlet connected to the high pressure chamber and an outlet connected to the fuel supply passage; and means for selectively opening the second electromagnetic valve to communicate the high pressure chamber with the fuel supply passage for at least a predetermined minimum time period in response to closing of the first electromagnetic valve.

2. A fuel injection pump according to claim 1 wherein said means for selectively communicating the high pressure chamber with a vent passage for controlling the amount of fuel delivered during each fuel injection comprises said second electromagnetic valve, said vent passage communicating with said fuel supply passage.

3. A fuel injection pump for a diesel engine, the pump comprising:

(a) a housing having a bore formed therein;

(b) a plunger slidably fitted in said bore for reciprocation with respect to the housing in response to rotation of the engine, the bore defining a high pressure chamber at one end of the plunger;

(c) a first electromagnetic valve for shutting off fuel to the pump when the engine is not running, the valve having an inlet adapted to be connected to a source of fuel at relatively low pressure and an outlet;

(d) a fuel supply passage having an upstream end connected to the outlet of the first electromagnetic valve and a downstream end leading to said high pressure chamber;

(e) means for communicating the downstream end of the fuel supply passage with said high pressure chamber substantially only when the plunger is moving in a first direction to enlarge the high pressure chamber;

(f) means for communicating the high pressure chamber with a fuel injection line substantially only when the plunger is moving in a second direction to reduce the size of the high pressure chamber;

(g) means for selectively communicating the high pressure chamber with a vent passage for controlling the amount of fuel delivered during each fuel injection, wherein the improvement comprises:

a second electromagnetic valve having an inlet connected to the high pressure chamber and an outlet connected to the fuel supply passage; and means for selectively opening the second electromagnetic valve to communicate the high pressure chamber with the fuel supply passage for at least a predetermined minimum time period in response to closing of the first electromagnetic valve; and wherein said means for selectively communicating the high pressure chamber with a vent passage for controlling the amount of fuel delivered during each fuel injection comprises said second electromagnetic valve, said vent passage communicating with said fuel supply passage; and wherein said second electromagnetic valve is a normally closed type which opens only when supplied with actuating electrical energy, and said means for selectively opening the second electromagnetic valve comprises means for supplying actuating electrical energy to the valve for a predetermined time period in response to closing of the first electromagnetic valve.

4. A fuel injection pump for a diesel engine, the pump comprising:

(a) a housing having a bore formed therein;

(b) a plunger slidably fitted in said bore for reciprocation with respect to the housing in response to rotation of the engine, the bore defining a high pressure chamber at one end of the plunger;

(c) a first electromagnetic valve for shutting off fuel to the pump when the engine is not running, the valve having an inlet adapted to be connected to a source of fuel at relatively low pressure and an outlet;

(d) a fuel supply passage having an upstream end connected to the outlet of the first electromagnetic valve and a downstream end leading to said high pressure chamber;

(e) means for communicating the downstream end of the fuel supply passage with said high pressure chamber substantially only when the plunger is moving in a first direction to enlarge the high pressure chamber;

(f) means for communicating the high pressure chamber with a fuel injection line substantially only when the plunger is moving in a second direction to reduce the size of the high pressure chamber;

(g) means for selectively communicating the high pressure chamber with a vent passage for controlling the amount of fuel delivered during each fuel injection, wherein the improvement comprises:

a second electromagnetic valve having an inlet connected to the high pressure chamber and an outlet connected to the fuel supply passage; and means for selectively opening the second electromagnetic valve to communicate the high pressure chamber with the fuel supply passage for at least a predetermined minimum time period in response to closing of the first electromagnetic valve; and wherein said means for selectively communicating the high pressure with a vent passage for controlling the amount of fuel delivered during each fuel injection comprises said second electromagnetic valve, said vent passage communicating with said fuel supply passage; and wherein said second electromagnetic valve is a normally open type which closes only when supplied with actuating electrical energy.

* * * * *

UNITED STATES PATENT AND TRADEMARK OFFICE

CERTIFICATE OF CORRECTION

PATENT NO. : 4,563,992

DATED : January 14, 1986

INVENTOR(S) : F. Kobayashi et al.

It is certified that error appears in the above-identified patent and that said Letters Patent is hereby corrected as shown below:

ABSTRACT, line 5, omit "being".

ABSTRACT, line 8, change "and being communicated" to --and is communicated--.

TITLE, line 4 [54], change "SPLIT" to --SPILT--.

DATE, line [22], change "Sep. 13," to --Sept. 13--.

Column 1, line 5, change "SPLIT" to --SPILT--.

Column 1, line 12, change "split" to --spilt--.

Column 1, line 14, change "or a" to --for a--.

Column 2, line 29, after "is" insert a comma.

Column 2, line 30, after "above" insert a comma.

Column 5, line 50, change "time" to --timer--.

Column 6, line 2, change "(among other signal)" to --(among other signals)--.

UNITED STATES PATENT AND TRADEMARK OFFICE

CERTIFICATE OF CORRECTION

PATENT NO. : 4,563,992

DATED : January 14, 1986

INVENTOR(S) : F. Kobayashi et al.

It is certified that error appears in the above-identified patent and that said Letters Patent is hereby corrected as shown below:

Column 7, line 5, change "side" to --said--.

Column 10, line 15, after "rotating" insert a comma.

Column 10, line 21, after "running" insert a comma.

Column 10, line 36, change "in this program, step S1 of" to --in step S1 of this program,--.

Signed and Sealed this

*Twenty-fourth* Day of *June 1986*

[SEAL]

*Attest:*

DONALD J. QUIGG

*Attesting Officer*

*Commissioner of Patents and Trademarks*